US006739218B2

(12) United States Patent
Yang

(10) Patent No.: US 6,739,218 B2
(45) Date of Patent: May 25, 2004

(54) HAMMER WITH RESILIENT SWIVEL PIVOTED JOINT

(76) Inventor: Tai-Her Yang, No. 59, Chung Hsiao 8 St., Si-Hu Town, Dzan-Hwa (TW)

( * ) Notice: Subject to any disclaimer, the term of this patent is extended or adjusted under 35 U.S.C. 154(b) by 25 days.

(21) Appl. No.: 10/123,147

(22) Filed: Apr. 17, 2002

(65) Prior Publication Data

US 2003/0196521 A1 Oct. 23, 2003

(51) Int. Cl.[7] ..... B25D 1/00
(52) U.S. Cl. ..... 81/20; 81/22
(58) Field of Search ..... 81/20, 22; 30/308.1

(56) References Cited

U.S. PATENT DOCUMENTS 1,729,328 A * 9/1929 Chilton ..... 267/270
1,983,796 A * 12/1934 Geyer ..... 403/226
2,026,774 A * 1/1936 Davis et al. ..... 29/898.042
2,048,256 A * 7/1936 Geyer ..... 403/228
2,852,287 A * 9/1958 Baker ..... 403/226
4,729,170 A * 3/1988 Hartmeister ..... 30/363
5,029,496 A * 7/1991 Catania ..... 81/22
5,261,164 A * 11/1993 Bellegante ..... 30/308.1
6,128,977 A * 10/2000 Gierer et al. ..... 81/22

* cited by examiner

*Primary Examiner*—M. Rachuba
(74) *Attorney, Agent, or Firm*—Rabin & Berdo, P.C.

(57) ABSTRACT

A hammer adapted to its head and handle at least with a resilient swivel pivoted joint so to swing with the swivel point as the pivot in the same direction as that of the striking to release the counter force instantaneously generated as the hammer strikes a work piece, so to avoid hurting the user's fingers and limbs.

12 Claims, 14 Drawing Sheets

A-A'

B-B'

C-C'

D-D'

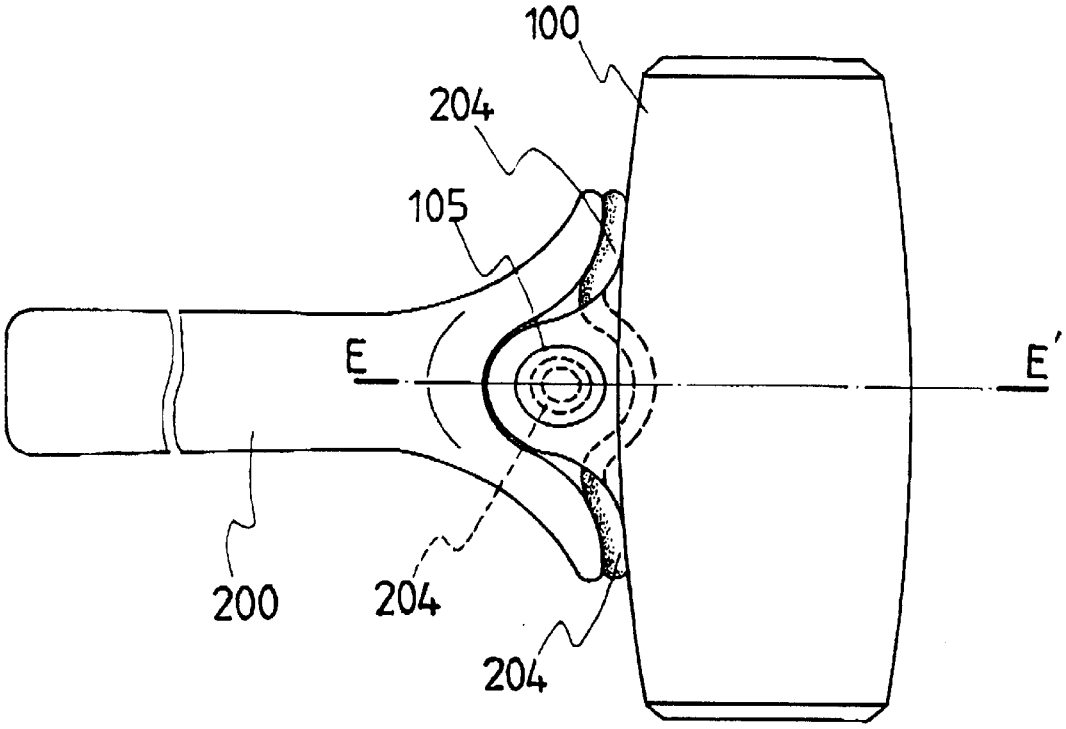
FIG 9
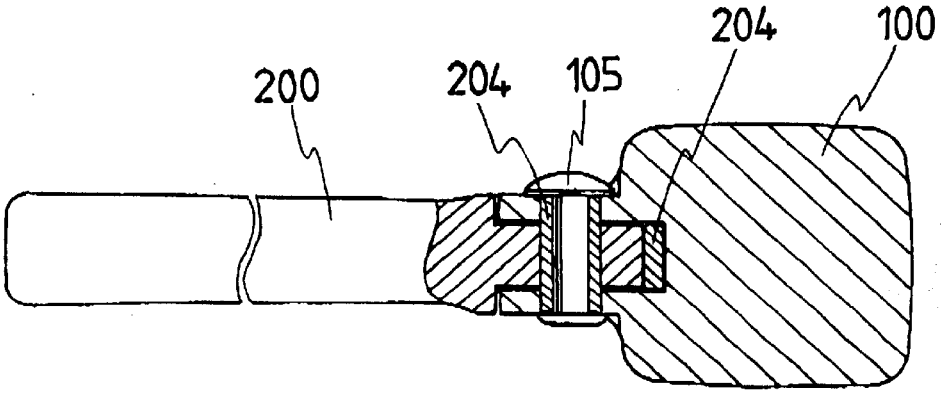
E-E' FIG 10

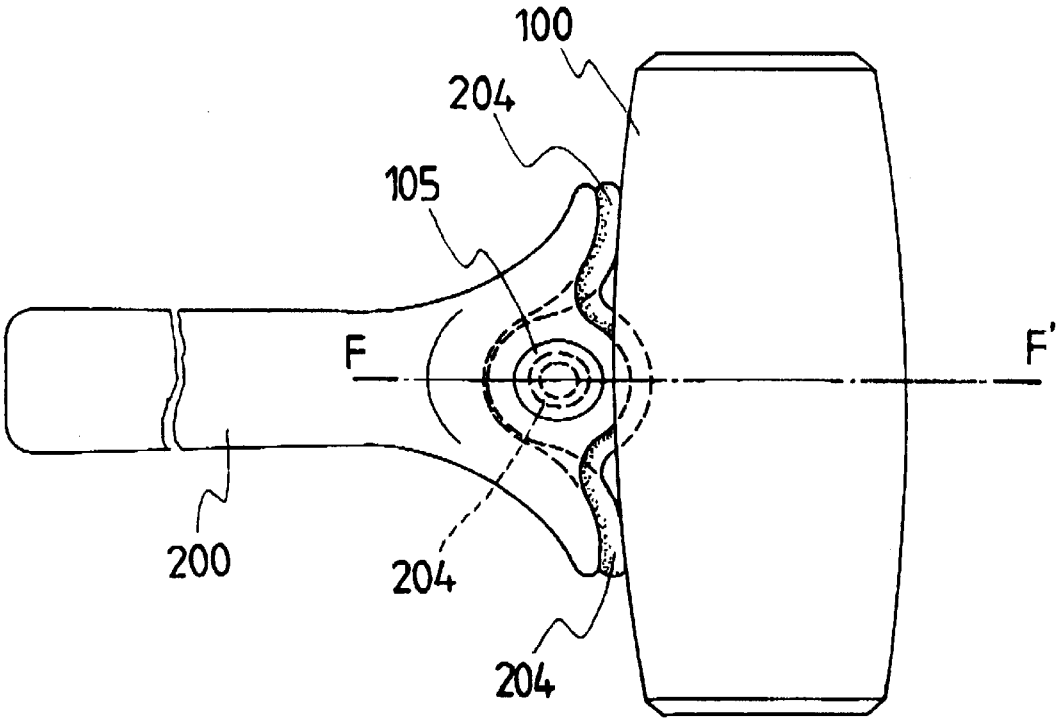
FIG 11
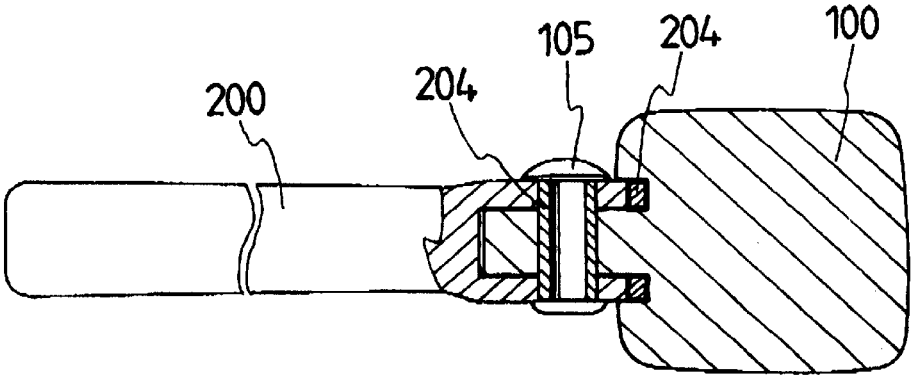
F-F' FIG 12

J-J'

HAMMER WITH RESILIENT SWIVEL PIVOTED JOINT

BACKGROUND OF THE INVENTION (a) Field of the Invention

The present invention is related to a hammer having a resilient swivel pivoted joint, and more particularly, to a hammer that has a resilient swivel pivoted joint that swings with at a pivot of the resilient swivel pivoted joint, to release a counter force instantaneously created as the hammer strikes an object, so to avoid possible injury to a user of the hammer.

(b) Description of the Prior Art

A conventional hammer usually has a handle and a head rigidly incorporated to each other, or has a flexible member inserted in a structure where the head and the handle axially penetrate through the structure to be incorporated into each other. In either case, the instantaneous counter force created when the hammer strikes an object will be transmitted back to the handle. As a result, particularly in intensive and heavy strikes, one could easily get his fingers and arm hurt.

SUMMARY OF THE INVENTION

The primary purpose of the present invention is to provide a hammer having at least a resilient swivel pivoted joint, so that the hammer head swings at the swivel point in the same direction as that of the striking to release the counter force instantaneously generated as the hammer strikes a work piece, so to avoid hurting the user's fingers and limbs.

BRIEF DESCRIPTION OF THE DRAWINGS

FIG. 9 is a view of a third preferred embodiment of the present invention.

FIG. 10 is a sectional view of E–E' taken from FIG. 9.

FIG. 11 is a view of a resilient swivel pivoted joint taken from FIG. 9 showing an opposite structure.

FIG. 12 is a sectional view of F–F' taken from FIG. 11.

DETAILED DESCRIPTION OF THE PREFERRED EMBODIMENTS

A hammer according to the present invention includes one or more than one swivel pivoted joint, that allows a hammer head to swing in a direction of the hammer strikes so to release a counter force instantaneously at the time of the striking. The counter force is released in the swinging direction, having the swivel pivot as a center of rotation, thus to avoid possible injury to one's fingers and limbs.

Figure 1:
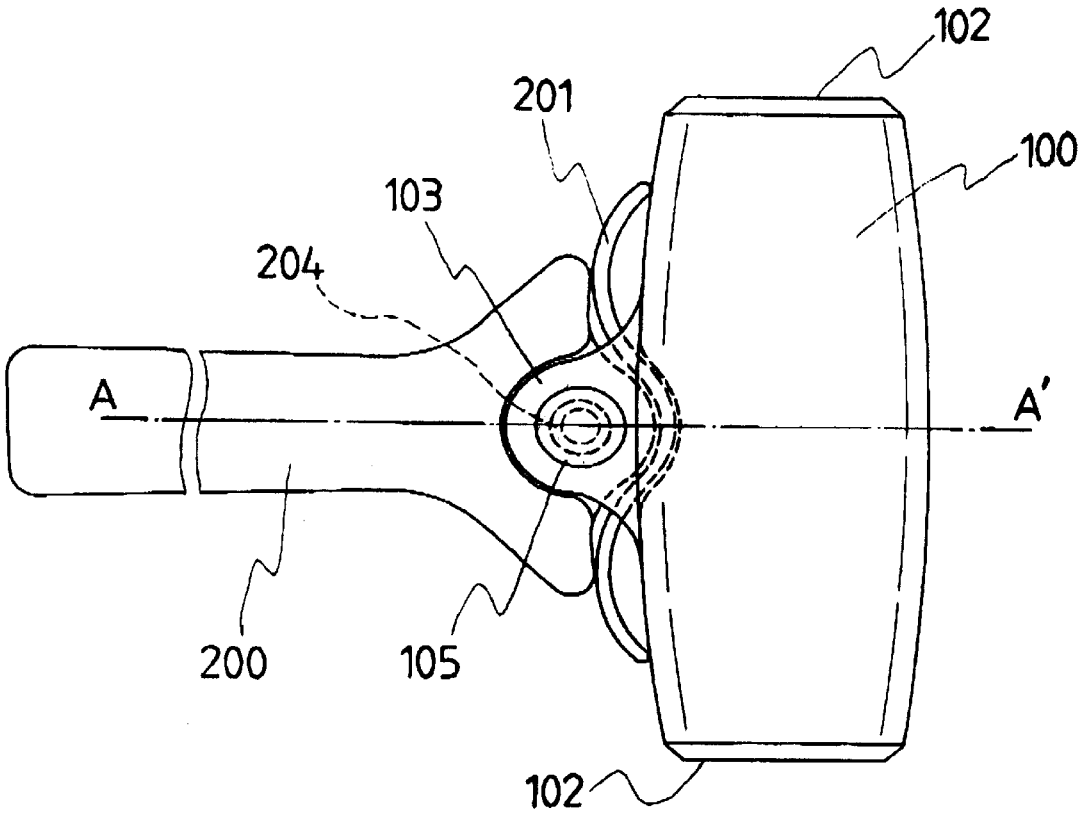
FIG. 1 is a view of a first preferred embodiment of the present invention.
Figure 2:
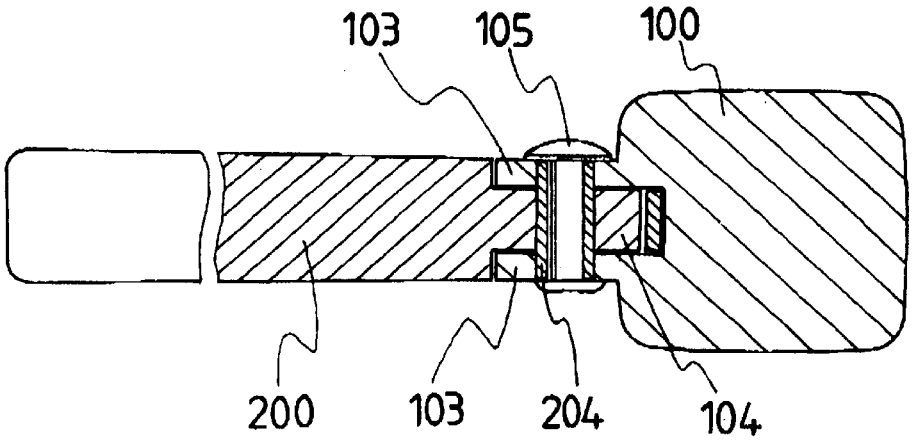
FIG. 2 is a sectional view of A–A' taken from FIG. 1.
Figure 3:
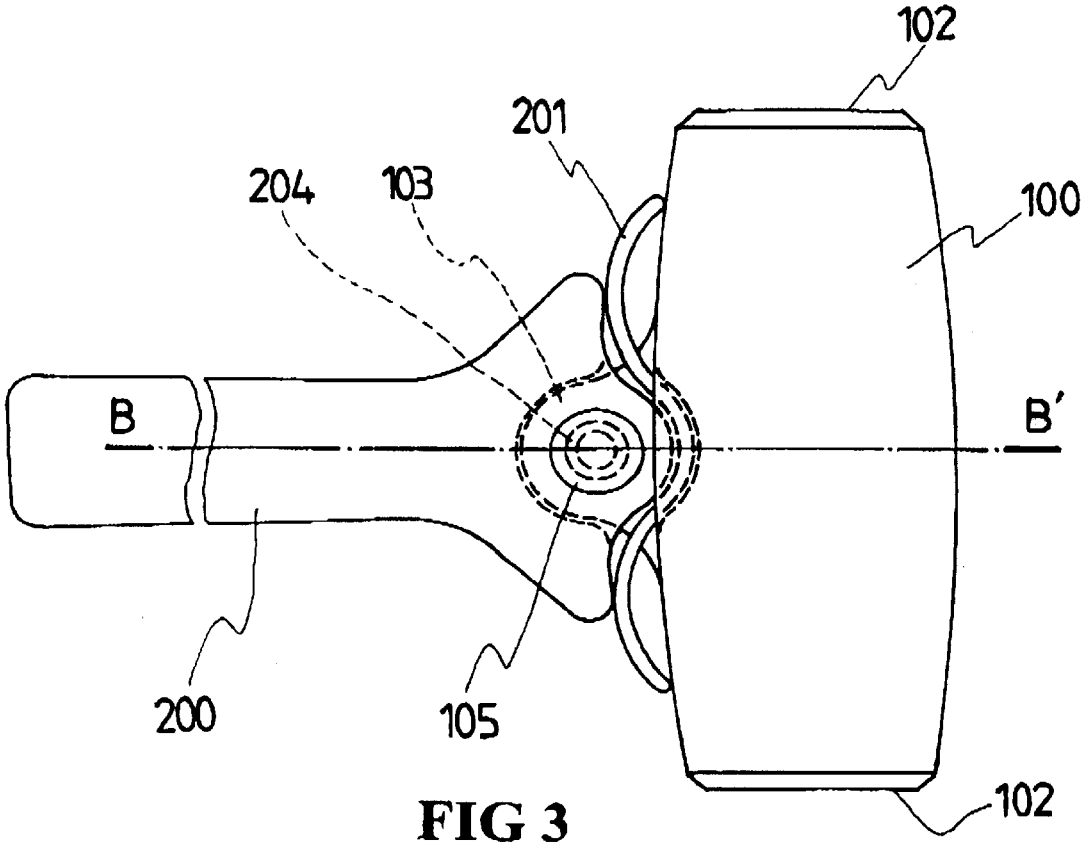
FIG. 3 is a view of a resilient swivel pivoted joint taken from FIG. 1 showing an opposite structure.
Figure 4:
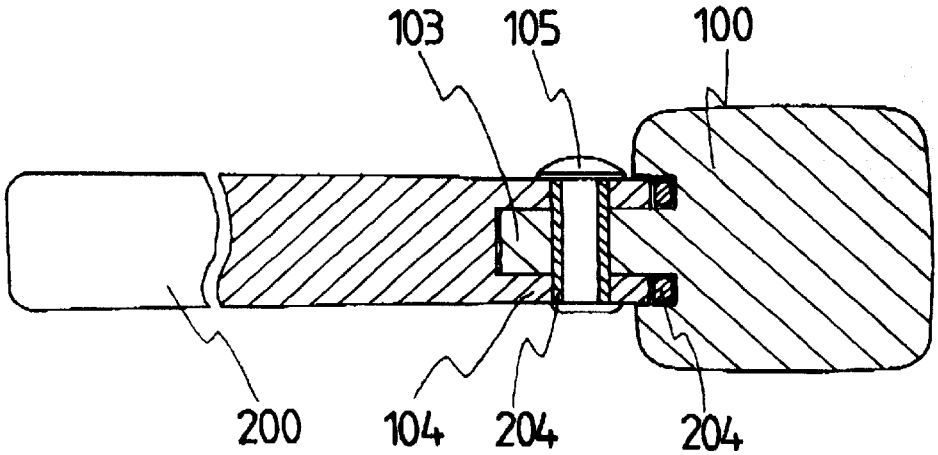
FIG. 4 is a sectional view of B–B' taken from FIG. 3.

FIG. 1 shows a first preferred embodiment of the present invention. FIG. 2 is a sectional view of A–A' taken from FIG. 1. FIG. 3 is a view of a resilient swivel pivoted joint taken from FIG. 1 showing an opposite structure. FIG. 4 is a sectional view of B–B' taken from FIG. 3.

The hammer of the first preferred embodiment includes a swivel hammerhead structure 100 having two striking ends 102, a pivot 103 and a pivot shaft 105. The pivot shaft 105 may be inserted into a resilient or flexible member 204 as elected. The pivot 103 is adapted so to allow the hammer head to execute an angular displacement by swinging in a striking direction when either of the striking ends strikes a work piece. A handle structure 200 includes a swivel pivot. One end of the handle structure 200 is adapted for a user to hold onto it, while the other end is an output end, and includes a pivot 104 that can be coupled to the pivot 103 using the pivot shaft 105. The pivot shaft 105 is attached either by locking, riveting or caulking, and further is inserted into a resilient or flexible sleeve member 204 as required. The pivot shaft 105 allows angular displacement between the swivel hammerhead structure 100 and the handle structure 200 when subject to a striking force.

Figure 5:
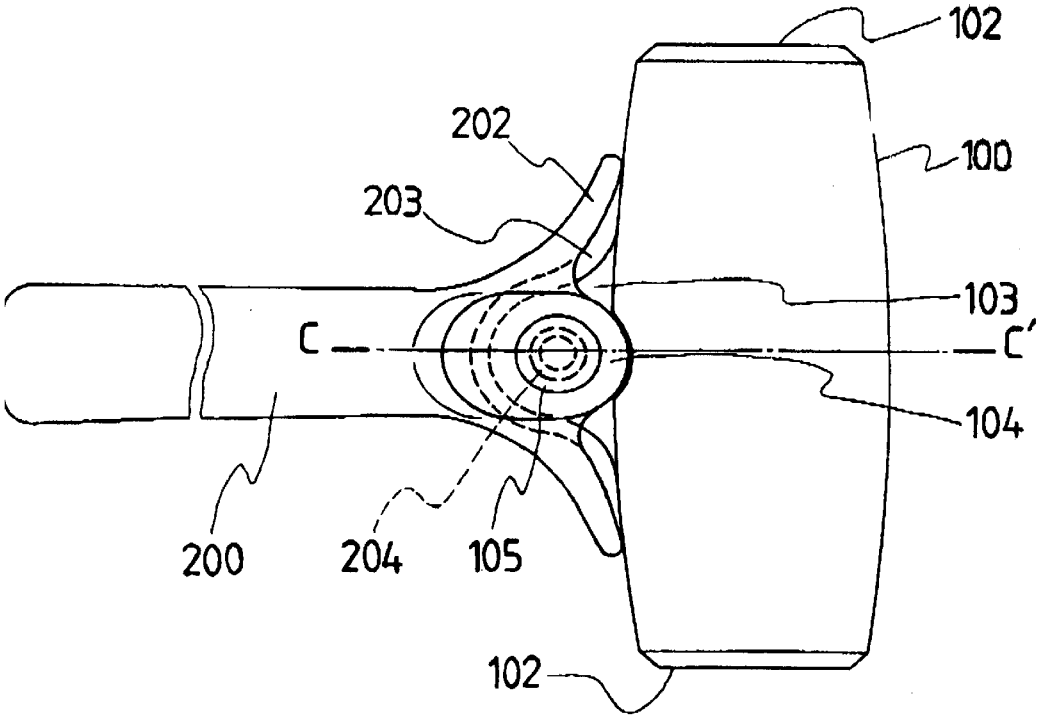
FIG. 5 is a view of a second preferred embodiment of the present invention.
Figure 6:
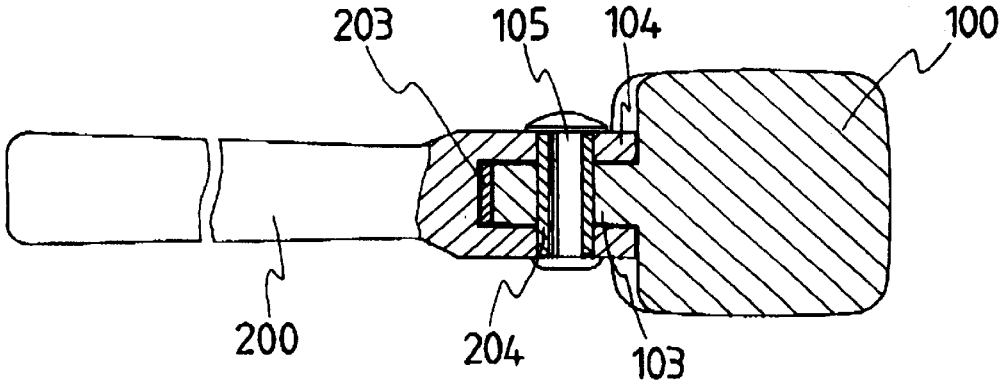
FIG. 6 is a sectional view of C–C' taken from FIG. 5.
Figure 7:
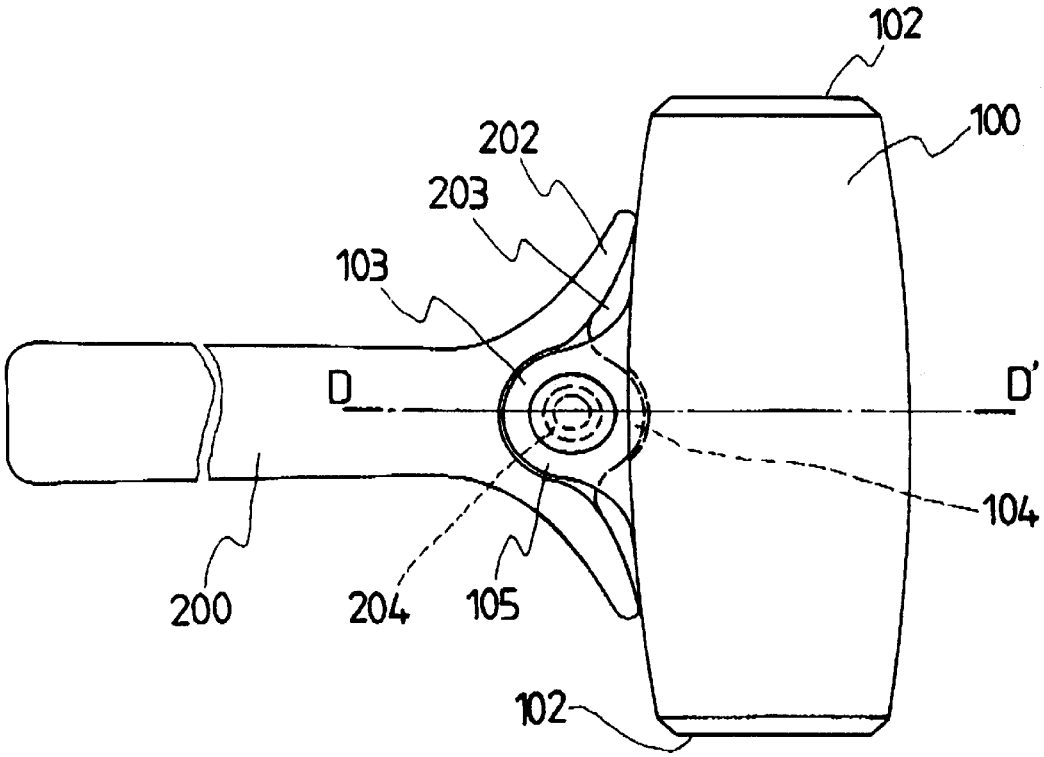
FIG. 7 is a view of a resilient swivel pivoted joint taken from FIG. 5 showing an opposite structure.
Figure 8:
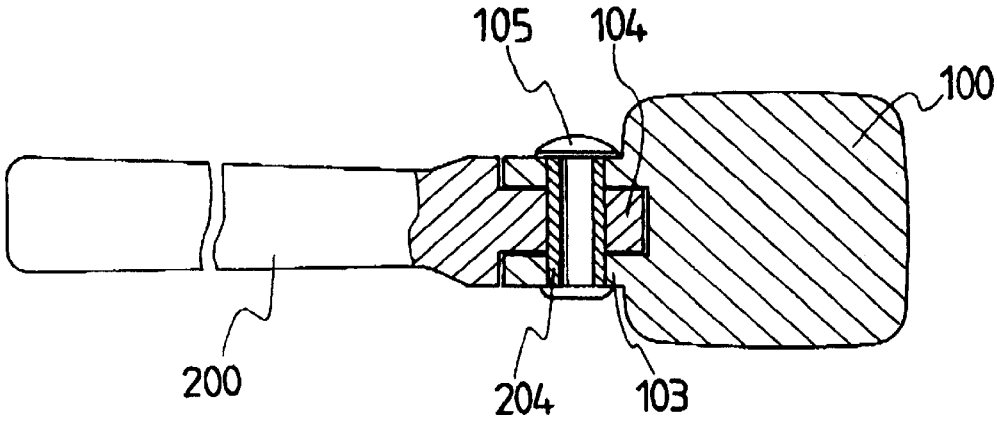
FIG. 8 is a sectional view of D–D' taken from FIG. 7.

A flexible limiting member for the pivoted joint angular displacement is provided between the swivel hammerhead structure 100 and the handle structure 200, which maintains both in a stabilized status when they are not subject to striking force, and to cause both to execute a flexibly angular displacement when subject to the striking force. The flexible limiting member includes a curved plate spring or an equivalent coil spring, or laminated spring 201. The flexible limiting member is disposed between the swivel hammerhead structure 100 and the handle structure 200 with swivel pivot. As illustrated in FIG. 5, a second preferred embodiment of the present invention is shown. FIG. 6 is a sectional view of C–C' taken from FIG. 5. FIG. 7 is a swivel joint in structure opposite to that in FIG. 5. FIG. 8 is a sectional view D–D' taken from FIG. 7. Either or both of the swivel hammerhead structure 100 and the handle structure 200 with swivel pivot extends toward a striking direction. A resilient structure 202 between the swivel hammerhead structure 100 and the handle structure 200 functions as the flexible limiting member for the pivoted joint displacement. A laminated spring 203 may be added between the resilient structure 202 and the swivel hammerhead structure 100.

As illustrated in FIG. 9, a third preferred embodiment of the present invention is shown. FIG. 10 is a sectional view of E–E' taken from FIG. 5. FIG. 11 is a swivel joint in structure opposite to that in FIG. 10. FIG. 12 is a sectional view F–F' taken from FIG. 11. A selected resilient or flexible member 204, such as one made of PU or other plastic material or rubber is disposed between the swivel hammerhead structure 100 and the handle structure 200 with swivel pivot to function as the flexible limiting member for the pivoted joint displacement.

Figure 13:
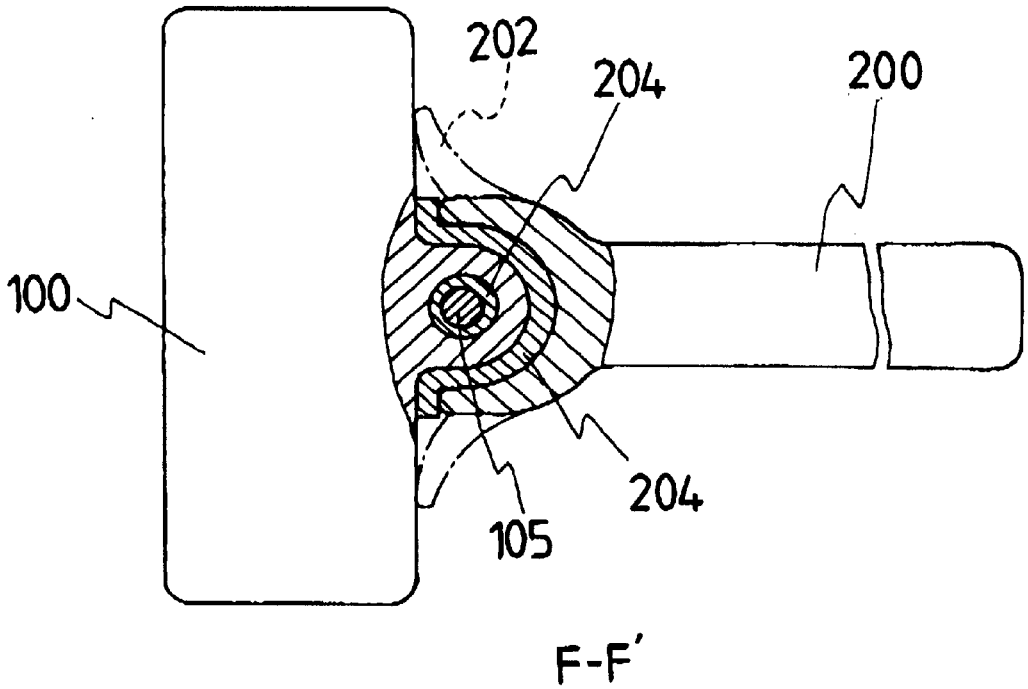
FIG. 13 is a view of a fourth preferred embodiment of the present invention.
Figure 14:
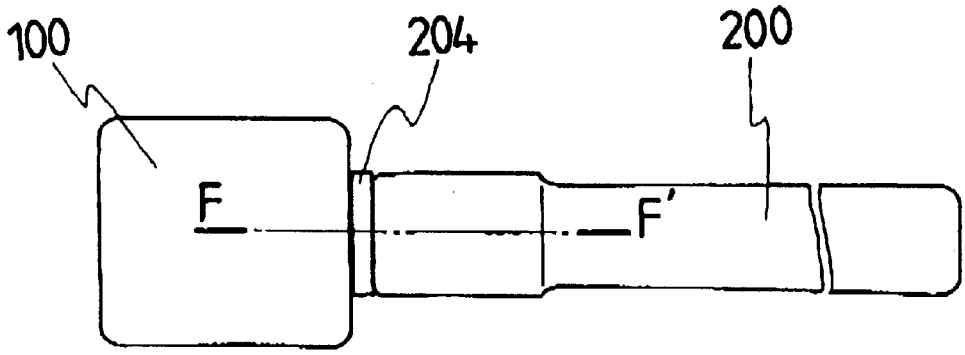
FIG. 14 is a sectional view of F–F' taken from FIG. 13.
Figure 15:
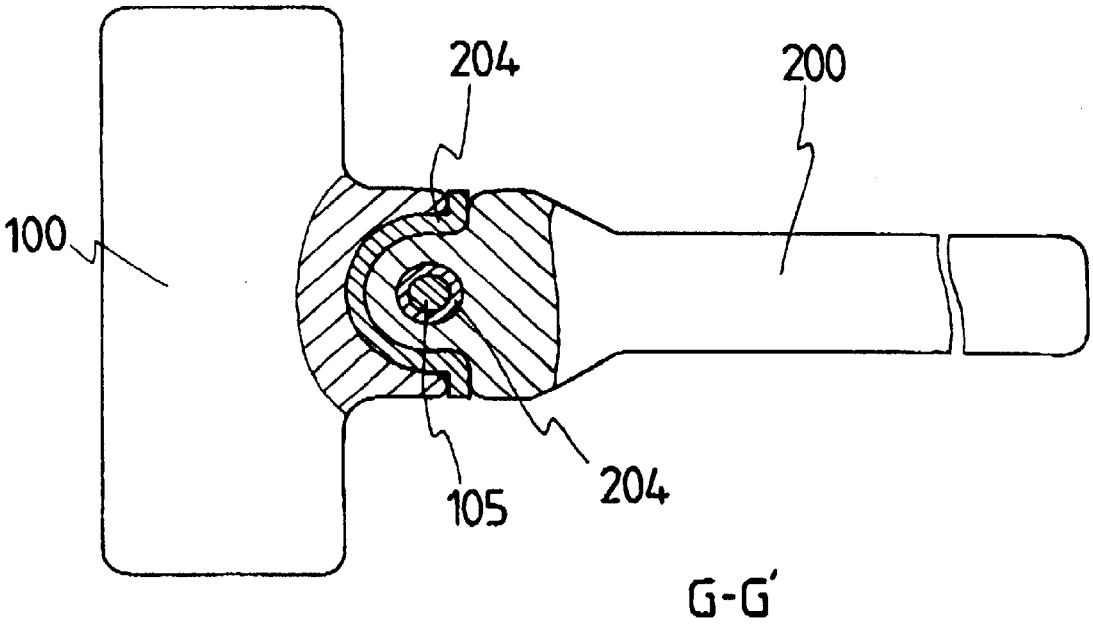
FIG. 15 is a view of a resilient swivel pivoted joint taken from FIG. 13 showing an opposite structure.
Figure 16:
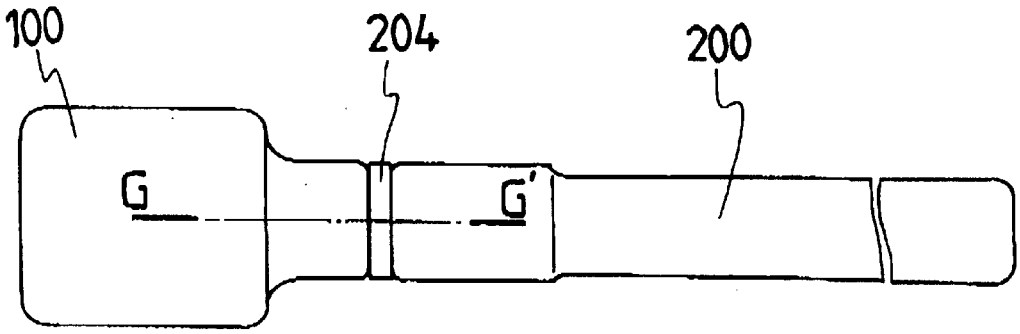
FIG. 16 is a sectional view of G–G' taken from FIG. 15.

FIG. 13 shows a fourth preferred embodiment of the present inventions. FIG. 14 is a sectional view of F–F' taken from FIG. 13. FIG. 15 is a swivel joint in structure opposite to that in FIG. 14. FIG. 16 is a sectional view G–G' taken from FIG. 15. A space is defined for executing an angular displacement in the striking direction by a pivoted structure formed by both pivots and between both of the swivel hammerhead structure 100 and the handle structure 200 with swivel pivot to be incorporated to each other. The resilient structure as disclosed in the preceding subparagraphs or the resilient or flexible member 204 as previously disclosed is further disposed in the space for executing angular displacement. Consequently, the handle structure 200 with swivel pivot is capable of maintaining a stable force application status on the flexibility of the swivel hammerhead structure 100 before the striking.

A spacing or the selected resilient or flexible member 204 such as that made of PU, other plastic or rubber material or structure is disposed between the handle structure 200 with swivel pivot and the swivel hammerhead structure 100 to function as the flexible limiting member for the pivoted joint displacement.

Figure 18:
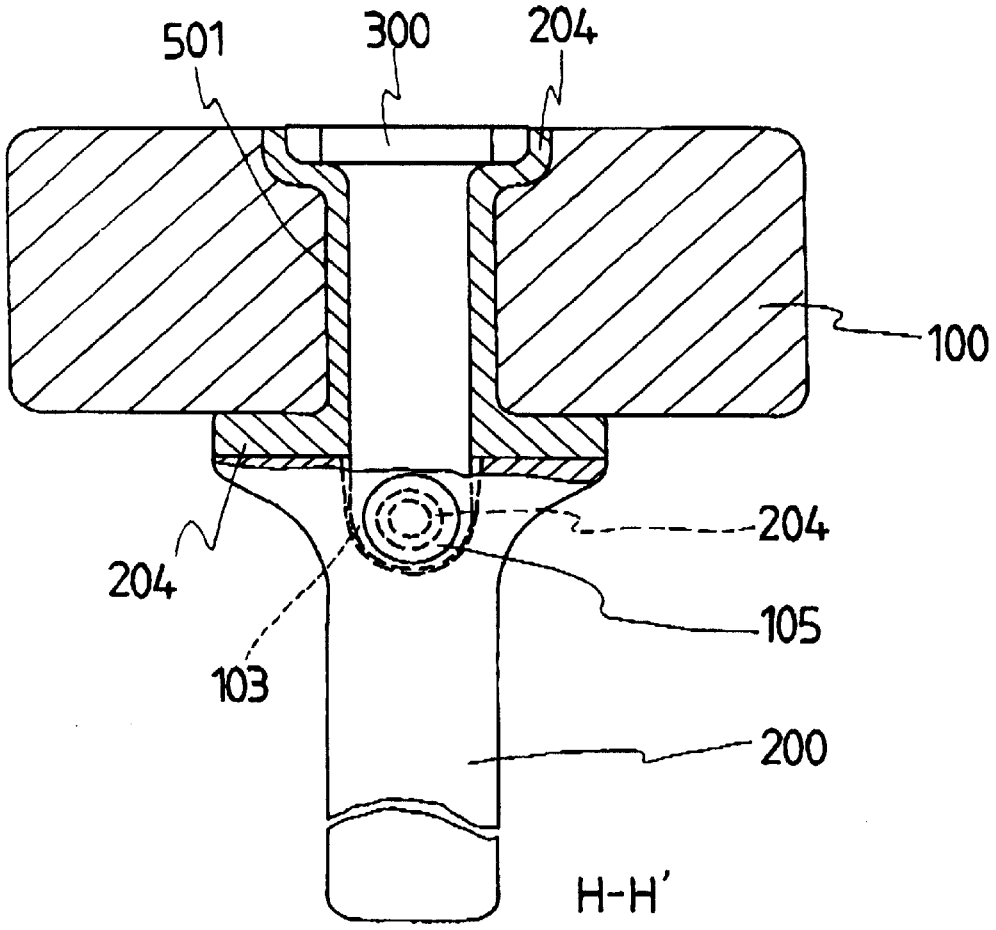
FIG. 18 is a sectional view of H–H' taken from FIG. 17.
Figure 17:
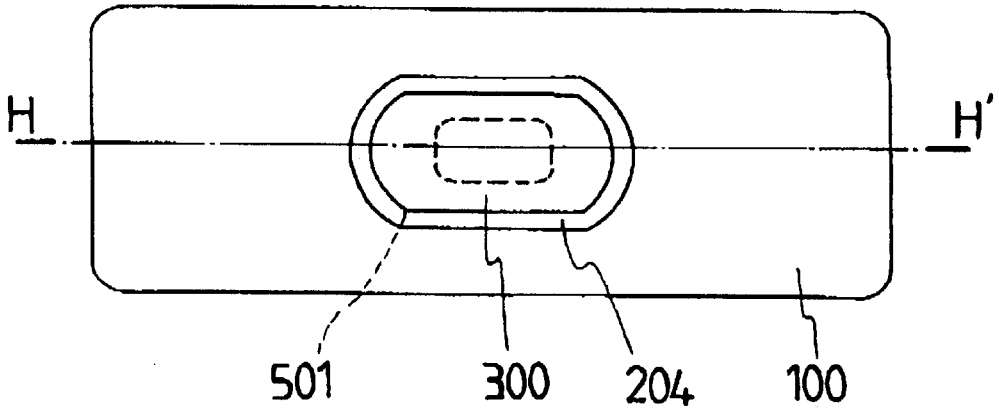
FIG. 17 is a view of a fifth preferred embodiment of the present invention.

Alternatively, the handle structure 200 with swivel pivot is adapted with a multi-sectional structure as illustrated in FIG. 17 for a fifth preferred embodiment of the present invention. FIG. 18 is a sectional view of H–H' taken from FIG. 17. A lateral opening 501 (or a tapered opening) having larger external gradation and smaller internal gradation is provided in the middle section of the swivel hammerhead structure 100 adapted to be inserted with a relay rod 300 having one end capped and the other end a pivot structures. The sectional form of the middle section of the relay rod 300 and the form of the opening 501 of the swivel hammerhead structure 100 relate to square or approximately square, or any other geometric sectional form that allows both of the relay rod 300 and the swivel hammerhead structure 100 when incorporated to each other to be prevent their rotation. The outer diameter of the capped end of the relay rod 300 is greater than the smaller diameter of the lateral opening 501 of the swivel hammerhead structure 100 to prevent falling off while the other end of the relay rod 300 provided with the pivot is coupled to the pivot 103 from the handle structure 200 with swivel pivot by means of the penetrating turning shaft 105. Wherein, the turning shaft 105 may be inserted with the resilient or flexible member 204 as required thus allowing the swivel hammerhead structure 100 to execute angular displacement swinging along the striking direction between the swivel hammerhead structure 100 and the handle structure 200 with swivel pivot. A flexible limiting mechanism for the pivoted joint displacement is further adapted between the swivel hammerhead structure 100 and the handle structure 200 with swivel pivot while the flexible limiting member for the pivoted joint displacement is placed at where between the relay rod 300 and the hammerhead including the selected resilient or flexible member 204 made of PU, other plastic material or rubber as disclosed in the preceding subparagraph (3) to function as the flexible limiting member for the pivoted joint displacement. One or more than one of those flexible limiting members for the pivoted joint displacement as disclosed in the preceding subparagraphs is provided between the swivel hammerhead structure 100 and the handle structure 200 with swivel pivot.

Figure 19:
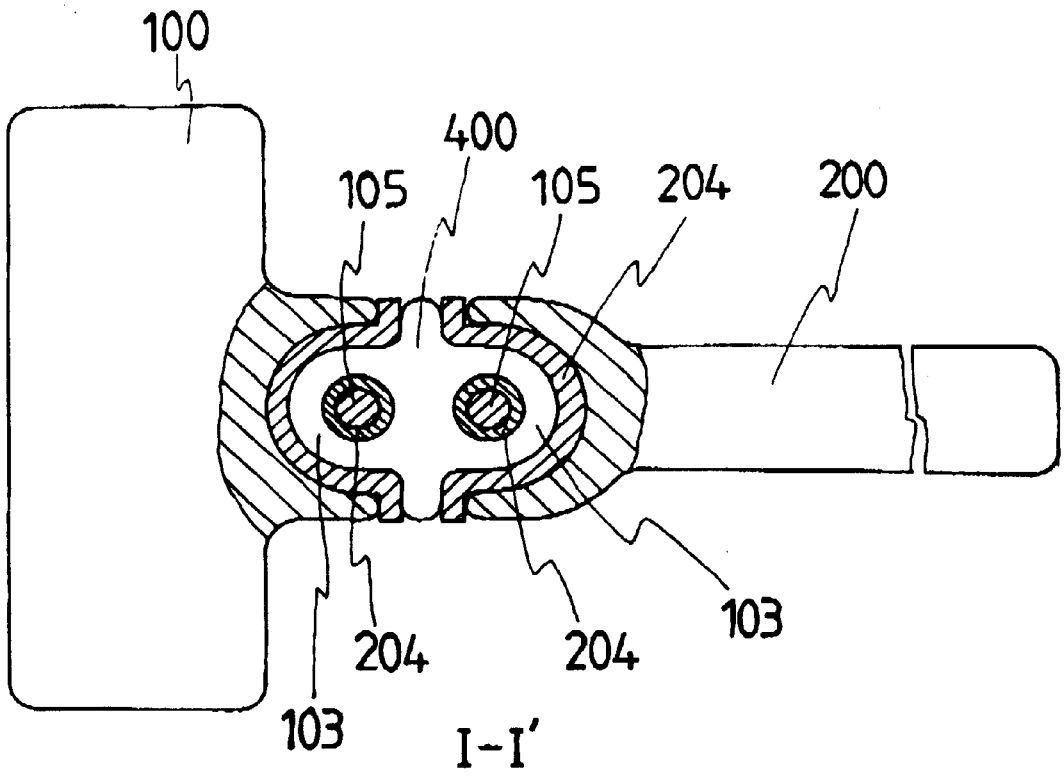
FIG. 19 is a view of a sixth preferred embodiment of the present invention.
Figure 20:
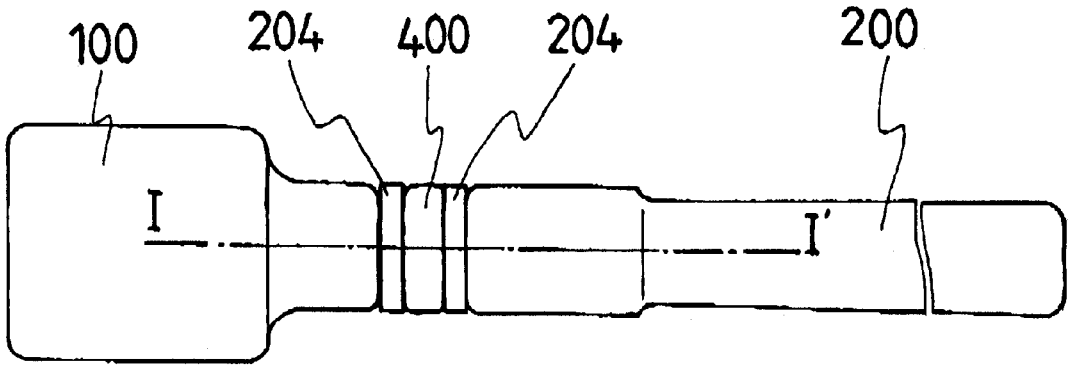
FIG. 20 is a sectional view of I–I' taken from FIG. 19.

Now refer to FIG. 19 for a sixth preferred embodiment of the present invention and FIG. 20 for a sectional view of I–I' taken from FIG. 19. The multi-sectional structure of the handle structure 200 with swivel pivot further comprises of an additional relay joint 400 disposed between the swivel hammerhead structure 100 and the handle structure 200 with swivel pivot, and a pivot each respectively provided to both ends of the relay joint 400 to be coupled to the pivot 103 of the swivel hammerhead structure 100 and the pivot of the handle structure 200 with swivel pivot by separately penetrating the turning shaft 105. As required, the turning shaft 105 may or may not be inserted with the resilient or flexible member 204. The middle section of the relay joint 400 extends externally to be coupled to both of the swivel hammerhead structure 100 and the handle structure 200 with swivel pivot so to provide the flexible limiting member for the pivoted joint displacement comprised of one or more than one configuration as disclosed in the preceding subparagraphs.

Figure 21:
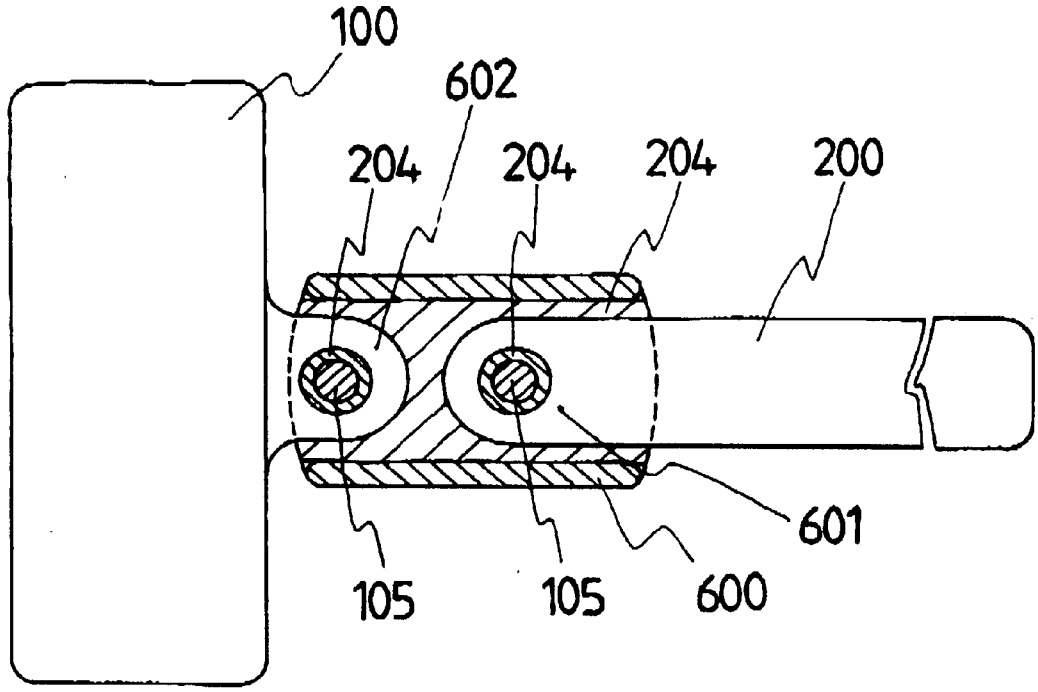
FIG. 21 is a view of a resilient swivel pivoted joint taken from FIG. 19 showing an opposite structure.
Figure 22:
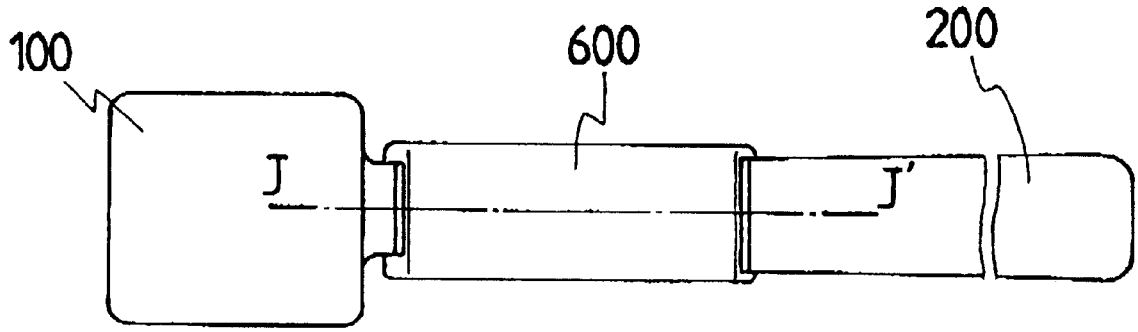
FIG. 22 is a sectional view of J–J' taken from FIG. 21.

FIG. 21 shows an opposite structure of the swivel joint to that illustrated in FIG. 19 and FIG. 22 is a sectional view of J–J' taken from FIG. 21. The handle structure in multi-sectional structure is further comprised of an additional relay joint 600 between the swivel hammerhead structure 100 and the handle structure 200 with swivel pivot. Both ends of the relay joint 600 are respectively with a pivot structure to be inserted to their corresponding pivot joints 601 and 602 from the handle structure 200 with swivel pivot and the swivel hammerhead structure 100 by penetrating the turning shaft 105. As required, the turning shaft 105 may or may not be inserted with the resilient or flexible member 204, and is comprised of one or more than one configuration as disclosed in the preceding subparagraphs.

Figure 23:
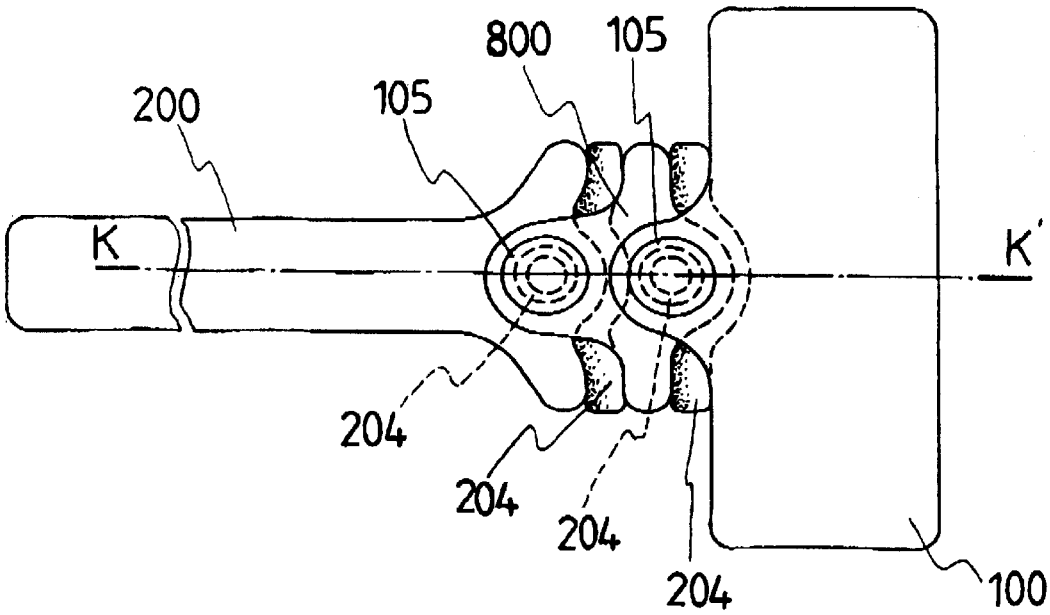
FIG. 23 is a view of a seventh preferred embodiment of the present invention.
Figure 24:
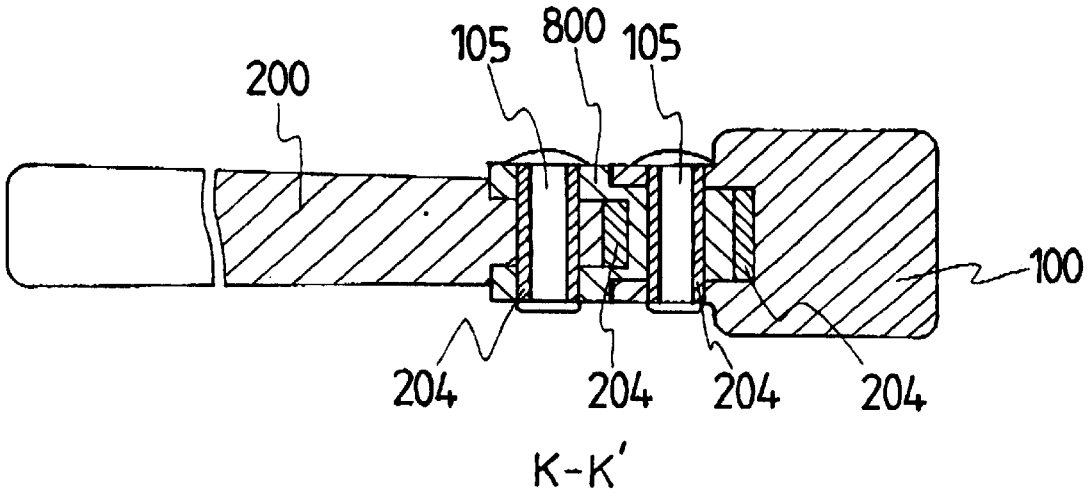
FIG. 24 is a sectional view of K–K' taken from FIG. 23.

FIG. 23 shows a seventh preferred embodiment of the present invention and FIG. 24 is a sectional view of K–K' taken from FIG. 23. The handle structure in multi-sectional structure is that the preferred embodiment illustrated in FIGS. 9 and 10 further comprised at where between the swivel hammerhead structure 100 and the handle structure 200 with swivel pivot of one or more than one section of a laminated or relay block 800 having respectively provided at its front and rear ends a pivot coupled to their corresponding pivots from the swivel hammerhead structure 100 and the handle structure 200 with swivel pivot by means of the turning shaft 105. The resilient or flexible member 204 is each respectively placed in where between the coupled pivots with their swivel angle that can be limited. As required, the turning shaft 105 may or may not be inserted with the resilient or flexible member 204.

Figure 25:
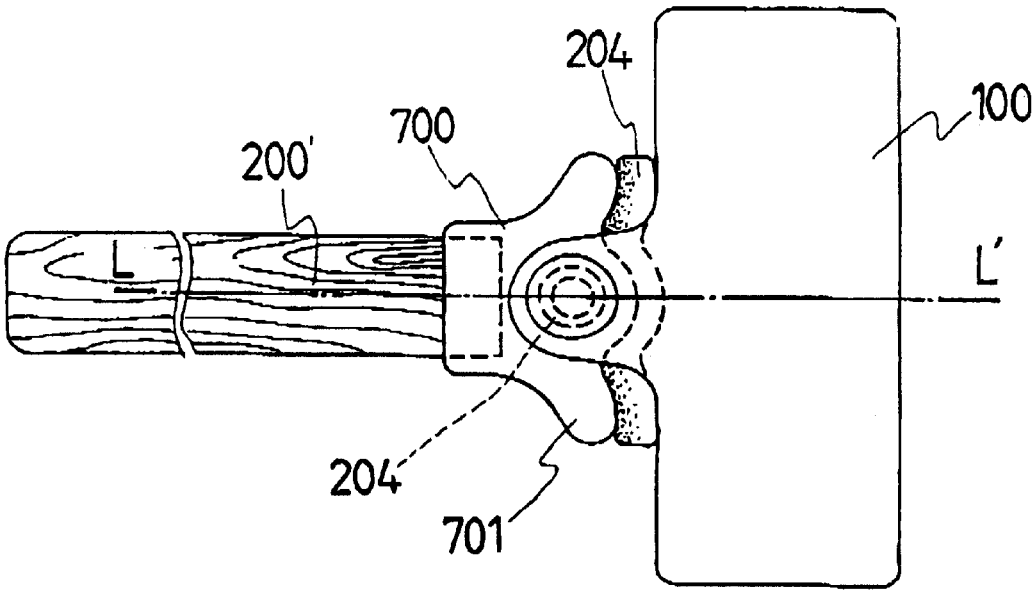
FIG. 25 is a view showing that the present invention is incorporated to a handle made of different materials.
Figure 26:
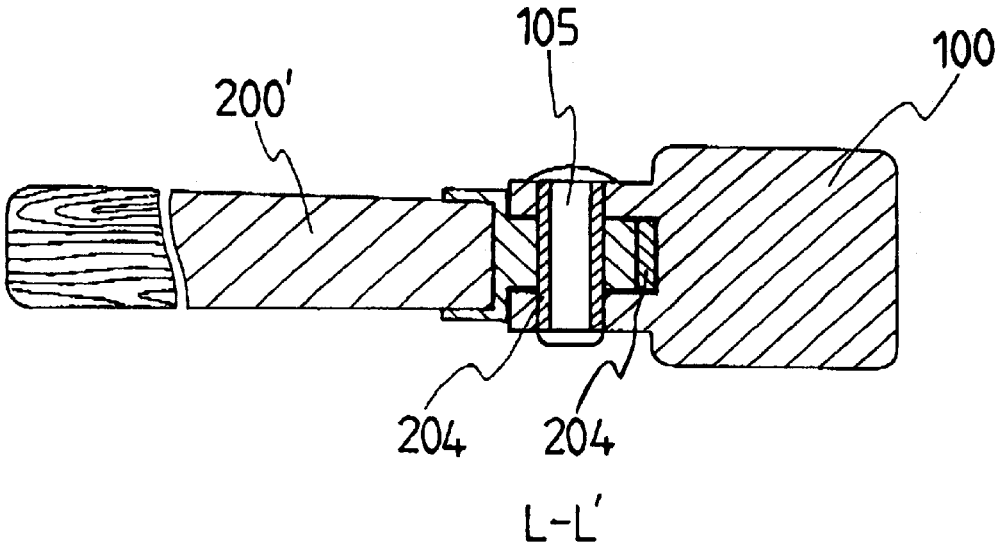
FIG. 26 is a sectional view of L–L' taken from FIG. 25.

Furthermore, to cope with various application needs, the present invention may be adapted with a handle made of different materials as a preferred embodiment illustrated in FIG. 25. FIG. 26 shows a sectional view of L–L' taken from FIG. 25. Wherein, one end 200' for grip of the handle structure 200 with swivel pivot is made of different material while the other end is incorporated to an output section 701 comprised of a pivot structure, then further coupled to the swivel hammerhead structure 100. An opening 700 adapted to be co-axially incorporated to the handle is disposed in the output section 701 comprised of the pivot structure, and the pivot structure 103 is provided to the output section 701 adapted to be coupled each other to the swivel hammerhead structure 100. The coupling between the output section 701 and the swivel hammerhead structure 100 is made by swivel by means of the turning shaft 105, which as required may be or may not be inserted with the resilient or flexible member 204. The handle made of different materials incorporated by means of the opening may be achieved by a packing means or by insertion of a fixed packing, or by taking advantage of adhesion or thermal contraction or other fixing means generally known to the practice of the prior art.

Figure 27:
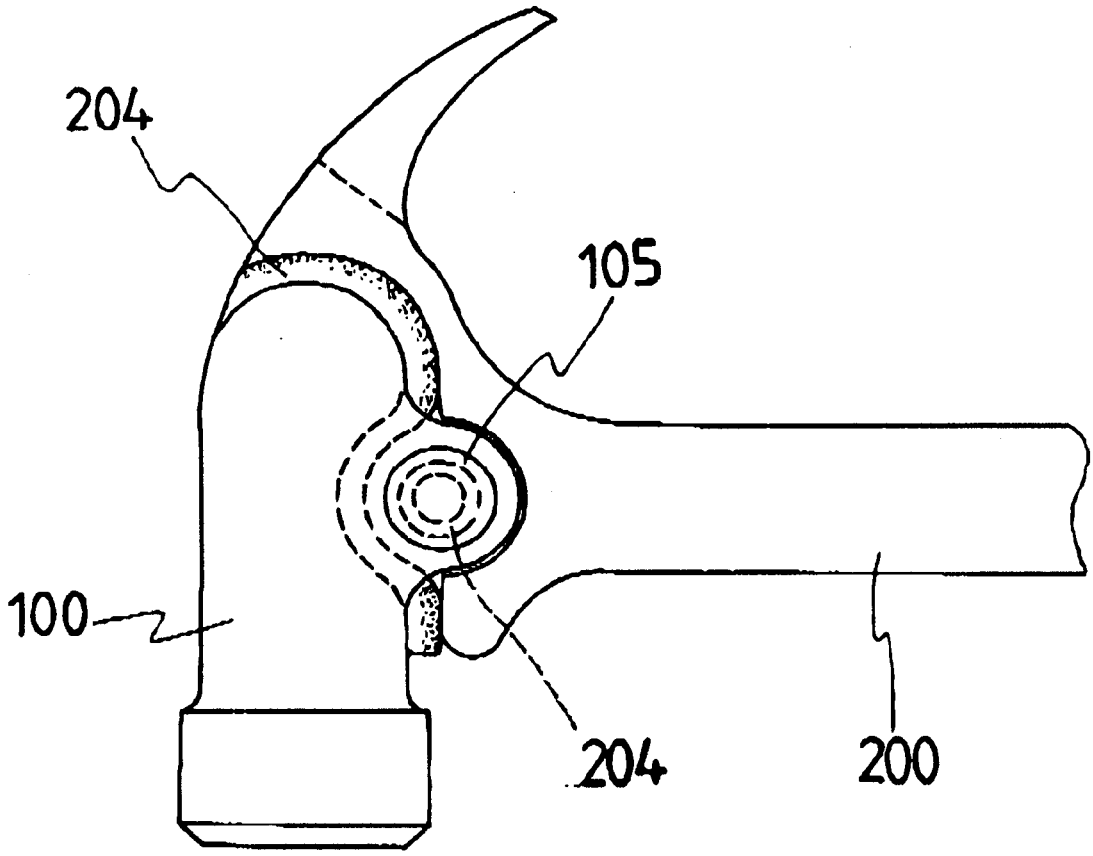
FIG. 27 is a view showing where a claw is located to the present invention.

In practice, the form and material for the hammerhead structure may vary depending on the application. A conventional claw may be provided to one end of the hammerhead structure of the present invention, or as illustrated in FIG. 27, wherein, the claw is provided to the handle structure 200 with swivel pivot that is further includes the output section of pivot structure. As disclosed, a hammer provided with a swivel resilient pivoted joint along its striking direction of the present invention by providing one or more than one swivel pivoted joint in the striking direction of the hammerhead and the handle that swings along the striking direction so to swing in the striking direction with the swivel pivot as the center to release the counter force instantaneously generated upon the hammer strikes a work object and thus to prevent injuries to fingers and limbs of a user of the hammer, is innovative in concept and providing its specific functions. Therefore, this application is duly filed accordingly.

What is claimed is:

1. A hammer, comprising:

a handle having at least one pivot hole at an end thereof;

a hammer head having at least one pivot hole at a base thereof;

a pivot shaft extending through the pivot hole of the handle and through the pivot hole of the hammer head, to pivotally connect the handle to the hammer head;

a resilient sleeve disposed around the pivot shaft, and extending into the pivot hole of the handle and into the pivot hole of the hammer head; and a flexible member disposed between the handle and the hammer head for generating a counter force when the hammer is used to strike a body.

2. The hammer recited in claim 1, wherein the hammer head has two striking ends.

3. The hammer recited in claim 1, wherein the flexible member is adapted to maintain both the handle and the hammer head in a stabilized status when they are not subject to a striking force, and to allow both the handle and the hammer head to angularly displace in a striking direction and relative to each other when subject to the striking force.

4. The hammer recited in claim 3, wherein the flexible member includes a spring.

5. The hammer recited in claim 4, wherein the spring longitudinally extends in the striking direction, and is disposed between the pivot shaft and the hammer head.

6. The hammer recited in claim 4, wherein the spring longitudinally extends in the striking direction, and is disposed between the pivot shaft and the handle.

7. The hammer recited in claim 3, wherein the flexible member limits an angular displacement between the handle and the hammer head in the striking direction when subject to the striking force.

8. The hammer recited in claim 1, wherein the flexible member is comprised of at least one of plastic and rubber.

9. The hammer recited in claim 1, wherein the hammer head has a lateral opening therethrough, and a relay rod disposed in the lateral opening, one end of the relay rod being pivotally connected to the handle using the pivot shaft, the flexible member being also disposed in the lateral opening and surrounding the relay rod.

10. The hammer recited in claim 9, wherein the relay rod has an enlarged head that has a diameter that is greater than a diameter of the lateral opening.

11. The hammer recited in claim 1, wherein the handle has a multi-sectional structure, and includes a relay joint pivotally connected to the hammer head using the pivot shaft, the handle further including a lower section pivotally connected to the relay joint.

12. The hammer recited in claim 1, wherein one end of the hammer head has a claw.

* * * * *